US005765647A

United States Patent [19]

Hood

[11] Patent Number: 5,765,647

[45] Date of Patent: Jun. 16, 1998

[54] GOLFING AID

[76] Inventor: Richard C. Hood, 118 W. Wilford St., Grafton, W. Va. 26354

[21] Appl. No.: 764,134

[22] Filed: Dec. 11, 1996

[51] Int. Cl.[6] ..... A63B 57/00

[52] U.S. Cl. ..... 172/371; 473/408; 172/378; 294/19.2

[58] Field of Search ..... 473/282, 286, 473/408; 294/19.2; 172/378, 375, 371

[56] References Cited

U.S. PATENT DOCUMENTS

| | | | |
|---|---|---|---|
| 1,182,918 | 5/1916 | McQuaide | 172/378 |
| 1,830,520 | 11/1931 | Moyses | 294/19.2 |
| 2,801,875 | 8/1957 | McEjoy | 473/286 |
| 2,819,108 | 1/1958 | Borah | 294/19.2 |
| 2,819,109 | 1/1958 | Borah | 294/19.2 |
| 4,011,612 | 3/1977 | Atkinson | 172/375 |
| 4,313,632 | 2/1982 | King | 294/19.2 |
| 4,974,894 | 12/1990 | Dubow | 294/19.2 |
| 5,094,456 | 3/1992 | Mitchell | 473/286 |
| 5,185,992 | 2/1993 | Garcia | 172/375 |
| 5,209,469 | 5/1993 | Laskowitz | 172/378 |
| 5,460,366 | 10/1995 | Pugh . | |

FOREIGN PATENT DOCUMENTS 2074926 11/1981 United Kingdom .

*Primary Examiner*—Sebastiano Passaniti
*Assistant Examiner*—Stephen L. Blau
*Attorney, Agent, or Firm*—Steptoe & Johnson

[57] ABSTRACT

A golfing aid is provided in which a pitch mark repair tool is mounted on the end of a shaft. The grip of the shaft can optionally have a ball retrieval device in the form of a suction cup having a plurality of inwardly biased or resilient fingers extending from its periphery.

1 Claim, 2 Drawing Sheets

GOLFING AID

FIELD OF THE INVENTION

This invention relates to a golfing aid, more particularly, but not exclusively, to an implement for repairing pitch marks and for retrieving balls.

BACKGROUND OF THE INVENTION

In golf, it is frequently necessary to repair pitch marks left by golf balls landing on greens. Pitch mark repair tools generally take the shape of two flat prongs extending from a handle. The prongs are generally no longer than the diameter of a golf ball, and the handle is usually shaped to fit between the thumb and crook of the forefinger.

Use of pitch mark repairers known to the art requires the user to bend or go down on a haunch. For many people, especially the elderly or handicapped, this can be a difficult task to perform.

Also, it can often be difficult to retrieve a ball from a difficult lie, for example under a bush. Existing devices are generally for retrieving balls from water hazards and are mostly unsuitable for retrieving balls from other lies.

OBJECT OF THE INVENTION

It is an object of this invention to provide a golfing aid which at least partially alleviates some of the problems mentioned above.

SUMMARY OF THE INVENTION

In accordance with this invention there is provided a golfing aid comprising an elongate shaft having a handle end and a tool end, and having a pitch mark repair tool mounted, optionally removably, on the tool end.

A further feature of this invention provide for the pitch mark repair tool to have a socket to provide a friction fit over the tool end of the shaft; for the pitch mark repair tool to have bifurcated flat prongs; and for the prongs to be inclined, in use, away from the axis of the shaft.

Still further features of the invention provide for the pitch mark repair tool to have a stem, the socket being located at one end, and the prongs at the opposite end thereof; for the axis of the stem to be inclined away from that of the socket, and for the axis of the prongs to be inclined, in use, away from that of the stem; and for the prongs to be hingedly attached to the stem to allow the prongs to be folded for storage.

The invention also provides for the golfing aid to include different tools selectively attached to the tool end of the shaft; for such tools to include a golf ball retrieval tool and a raking tool; for the golf ball retrieval tool to be in the shape of a perforated cup, and for the raking tool to be a toothed bar.

The invention further provides for the golfing aid to have a grip mounted on the handle end of the shaft, the free end of the grip terminating in a golf ball retrieval device; for the golf ball retrieval device to be a suction cup or to be a cup having a plurality of inwardly biased flexible fingers extending from its periphery to retain a golf ball located in the cup.

BRIEF DESCRIPTION OF THE DRAWINGS

A golfing aid will be described, by way of example only, with reference to the drawings, in which.

DETAILED DESCRIPTION OF THE DRAWINGS

Figure 1:
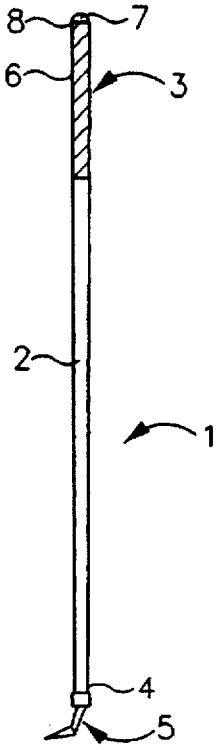
FIG. 1 is a side elevation of a shaft on which is mounted a pitch mark repair tool.

A golfing aid (1) is shown in FIG. 1 and comprises an elongate shaft (2) having a handle end (3) and a tool end (4). A pitch mark repair tool (5) is releasably mounted on the tool end(4). A grip (6) is attached to the handle end(3). A protrusion (7) at the free end (8) of the grip(6) is shaped to facilitate flattening of lifted patches of green (not shown).

Figure 2:
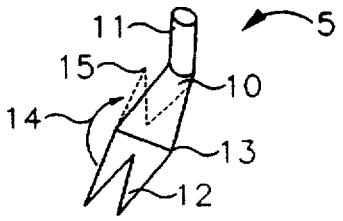
FIG. 2 is an isometric view of a pitch mark repair tool.

A pitch mark repair tool (5) is shown in more detail in FIG. 2. The tool comprises a stem (10) which has a socket (11) at one end and flat bifurcate prongs (12) at the opposite end thereof. The socket (11) provides a friction fit over the tool end (4) of the shaft (2). The axis of the stem (10) is inclined away from the axis of the socket(11), and the axis of the prongs (12) are inclined, in use, away from the axis of the stem (10).

A In this embodiment, the bifurcate prongs (12) are attached by a hinge (13) to the stem (10) so as to be able to fold towards the stem (10), as indicated by the arrow (14). In the folded position (15) (as indicated by the broken line), the tool (5) can be conveniently transported with a reduced possibility of the prongs (12) causing injury or damage.

Figure 3:
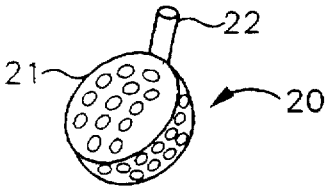
FIG. 3 is an isometric view of a golf ball retrieval tool.
Figure 4:
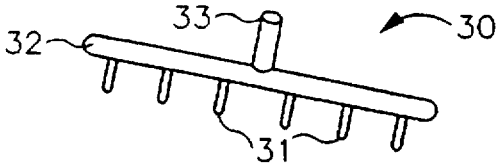
FIG. 4 is an isometric view of a raking tool.

A number of other tools can also be selectively mounted on the tool end (4) of the shaft (2). Such tools include, for example, a golf ball retrieval tool (20), as shown in FIG. 3, and a raking tool (30) as shown in FIG. 4. The golf ball retrieval tool (20) is a perforated cup (21) having a socket (22) extending therefrom. The rake (30) is a toothed bar (32) having a socket (33) to permit attachment to the shaft (2).

Figure 5:
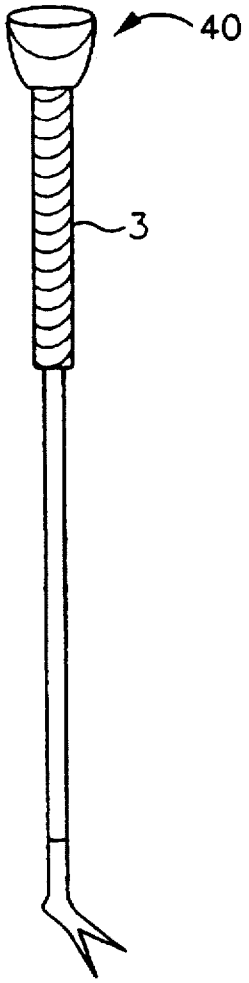
FIG. 5 is an isometric view of a first embodiment of a shaft having a grip with a golf ball retrieval device.
Figure 6:
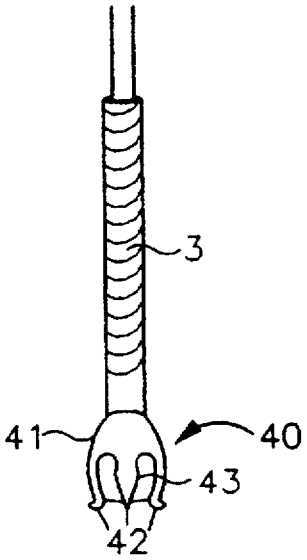
FIG. 6 is an isometric view of a second embodiment of a grip having a golf ball retrieval device.

A As shown in FIGS. 5 and 6, the grip (6) can also have a golf ball retrieval device (40) at its free end (8) instead of the protrusion (7) shown in FIG. 1.

In the embodiment in FIG. 5, the golf ball retrieval device (40) is a suction cup. In use, the cup is pressed over the ball (not shown) to encourage the ball to adhere to the cup.

Alternatively, as shown in FIG. 6, the golf ball retrieval device (40) can be a cup (41) having a plurality of inwardly biased flexible fingers (42) extending from its periphery.

In use, the fingers are forced over a ball (43) to retain the ball in the cup.

It is envisaged that the pitch mark repair tool (5) will help alleviate problems associated with bending, and that the other tools will provide a convenience, the retrieval tool (20) being useful where a ball is in a difficult lie, and the rake (30) being useful in sand traps where a conventional rake is not at hand.

It will be appreciated that many other embodiments of a golf aid exist which fall within the scope of the invention, especially as regards the means for mounting the pitch mark repair tool (5) on the shaft (2), the configuration of the pitch mark repair tool (5), and the types of other tools available and the for of the golf ball retrieval device (40) on the grip.

I claim:

1. A pitch mark repair tool comprising:

a stem:

a socket located at one end of said stem, wherein said socket provides a fiction fit over an end of an elongate shaft;

flat, bifurcate prongs located at an opposite end of said stem from said socket, wherein an axis of said flat, bifurcate prongs is inclined away from an axis of stem; and a hinge connecting said stem to said flat, bifurcate prongs, thereby allowing said flat, bifurcate prongs to be folded.

* * * * *